US007682769B2

(12) United States Patent
Koyama et al.

(10) Patent No.: US 7,682,769 B2
(45) Date of Patent: Mar. 23, 2010

(54) METHOD OF MANUFACTURING TONER, TONER, AND IMAGE FORMING METHOD

(75) Inventors: Mikio Koyama, Kunitachi (JP); Kenji Hayashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 949 days.

(21) Appl. No.: 11/413,844

(22) Filed: Apr. 28, 2006

(65) Prior Publication Data

US 2007/0015076 A1 Jan. 18, 2007

(30) Foreign Application Priority Data

Jul. 12, 2005 (JP) ..... 2005-202863

(51) Int. Cl.
*G03G 5/00* (2006.01)

(52) U.S. Cl. ..... 430/137.17; 430/109.4

(58) Field of Classification Search ..... 430/109.4, 430/137.17
See application file for complete search history.

(56) References Cited

U.S. PATENT DOCUMENTS 5,853,940 A * 12/1998 Kido et al. ..... 430/108.4
2005/0100808 A1 * 5/2005 Hashimoto et al. ..... 430/108.8

* cited by examiner

*Primary Examiner*—Mark A Chapman
(74) *Attorney, Agent, or Firm*—Squire, Sanders & Dempsey L.L.P.

(57) ABSTRACT

Disclosed is a method of manufacturing toner possessing the steps of conducting a polymerization process for acquiring wax-containing polyester resin particles via condensation-polymerization of carboxylic acid and alcohol employing oil droplets after forming the oil droplets made of wax and a polymerizable monomer containing at least one kind of carboxylic acid with divalence or more and at least one kind of alcohol with divalence or more in an aqueous medium containing a surfactant including a compound having a long chain hydrocarbon group and acidic group, and conducting a process of coagulating at least the wax-containing polyester particles in the aqueous medium.

8 Claims, 2 Drawing Sheets

COLORED PARTICLE HAVING NO CORNERS

COLORED PARTICLE HAVING CORNERS

FIG. 2 (c) COLORED PARTICLE HAVING CORNERS

METHOD OF MANUFACTURING TONER, TONER, AND IMAGE FORMING METHOD

TECHNICAL FIELD

The present invention relates to a method of manufacturing a toner, a toner prepared via this method, and an image forming method thereof.

BACKGROUND

In recent years, when an electrophotographic process is applied to form images, downsizing of toner particles is promoted in order to attain higher image quality, and a polymerized toner is manufactured to meet this demand. This polymerized toner is composed of resin particles prepared by conducting a polymerization process via emulsion polymerization and the like, colorant particles, and toner particles acquired by coagulating other particles as a toner composition if desired. After oil droplets are formed by dispersing a polymerizable monomer raw material in an aqueous medium, used subsequently to incorporate an emulsifier, the resin particles to acquire a polymerized toner were conventionally prepared via emulsion polymerization in which radical polymerization was conducted via oil droplets by adding a polymerization initiator. A styrene-acryl based resin particles exemplified, for example (refer to Patent Document 1 and Patent Document 2, for example).

Since kinds of polymerizable monomers used for radical polymerization are limited in such a toner manufacturing method, the resulting toner, however, is limited to toner particles composed of vinyl based resin particles or acryl based resin particles.

Since in the case of polyester resin, a toner exhibits excellent fixability obtained by excellent viscoelasticity of the polyester resin, a toner composed of toner particles containing coagulated polyester resin particles is desired. In order to acquire a toner containing such polyester resin particles, a solution in which the polyester resin is dissolved in an organic solvent is dispersed in an aqueous medium, and these polyester resin particle-to-polyester resin particle are subsequently coagulated with colorant particles, whereby toner particles can be prepared via solvent removal. This toner manufacturing method is exemplified (refer to Patent Document 3, for example). On the other hand, in the case of toner formed by toner particles made only of a polyester resin, an off-setting phenomenon is possibly generated with no sufficient releasing capability in a fixing process, whereby it is well-known, for example, that high releasing capability can be obtained by adding wax as a releasing agent into the polyester resin constituting toner particles It is, however, difficult to evenly disperse wax in the polyester resin, resulting in reducing the toner charging amount largely since a phenomenon of releasing wax from formed toner particles is generated, whereby the released wax is shifted to a carrier in the case of a two-component developer, and is also shifted to a developing sleeve in the case of a single-component developer. Particularly in the case of an image forming method to form color images by superimposing plural toner images employing color toner, color reproducibility is largely lowered via slight variation of the developing toner amount caused by a very small change of the charging amount.

The reason why it is difficult to evenly disperse wax in the polyester resin, though considered to be less certain, is that wax and a polyester resin are presumably phase-separated since wax is basically a material containing a nonpolar group such as a long-chain hydrocarbon group and so forth in the molecule, whereas a polyester resin is a material containing a number of polar groups such as an ester group and so forth in the molecular chain, in the case of employing a commonly known method, for example, of forming particles via pulverization after melting and kneading wax and a polyester resin, or forming particles via deliquoring after dispersing in the aqueous medium wax and a polyester resin which are dissolved in a cosolvent.

(Patent Document 1) Japanese Patent O.P.I. Publication No. 2000-214629

(Patent Document 2) Japanese Patent O.P.I. Publication No. 2001-125313

(Patent Document 3) Japanese Patent O.P.I. Publication No. 2004-109848

SUMMARY

An object of the present invention is to provide a method of manufacturing a toner, a toner prepared via this method, and the image forming method in which not only fixability at low temperature in a fixing process during image formation and fine line reproduction are excellent, but also high quality images can be stably formed over a long period of time with no generation of a wax releasing phenomenon, employing a polymerized toner containing polyester resin particles. Also disclosed is a method of manufacturing toner possessing the steps of conducting a polymerization process for acquiring wax-containing polyester resin particles via condensation-polymerization of carboxylic acid and alcohol employing oil droplets after forming the oil droplets made of wax and a polymerizable monomer containing at least one kind of carboxylic acid with divalence or more and at least one kind of alcohol with divalence or more in an aqueous medium containing a surfactant including a compound having a long chain hydrocarbon group and acidic group, and conducting a process of coagulating at least the wax-containing polyester particles in the aqueous medium.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
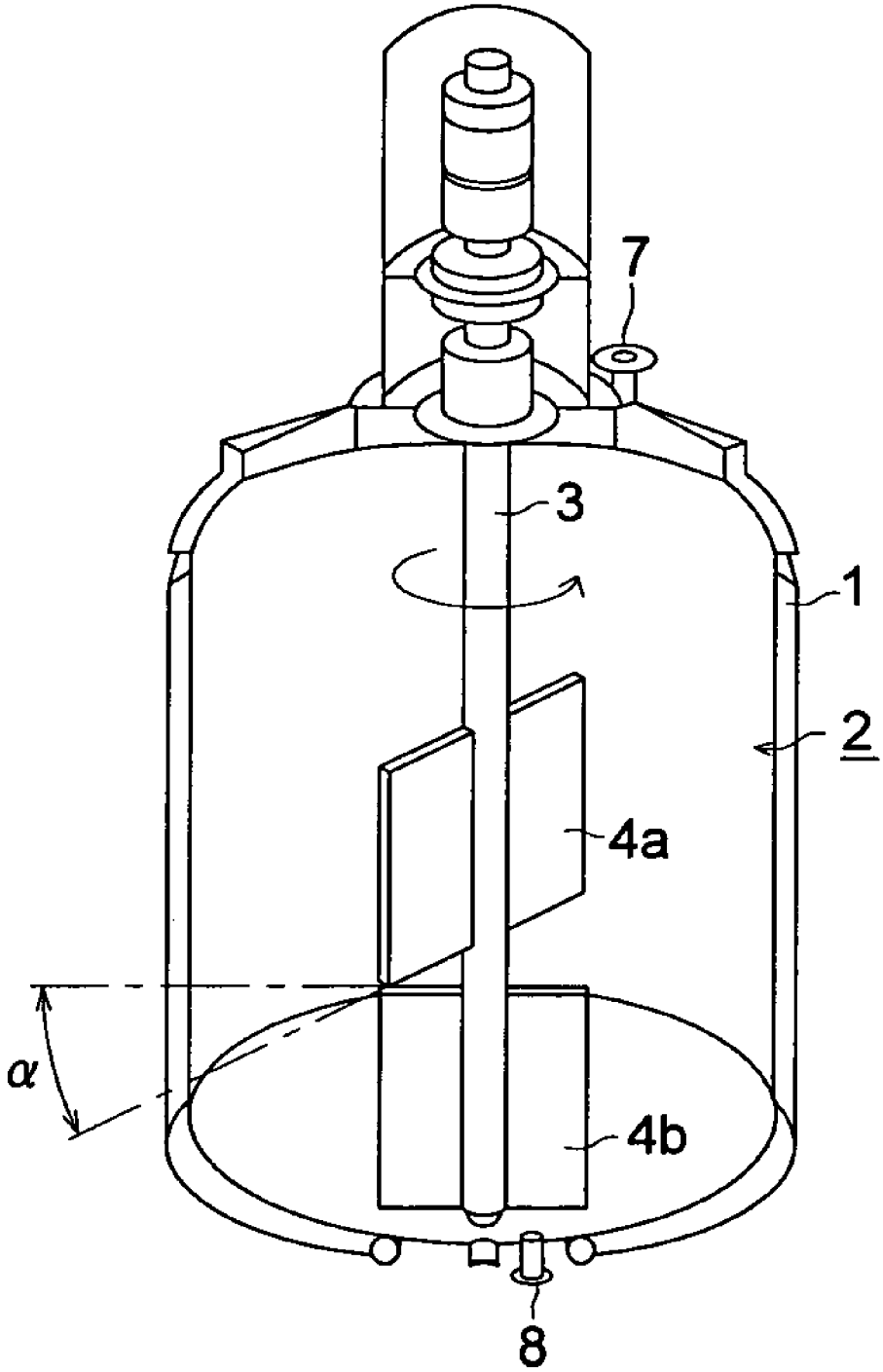
FIG. 1 is an oblique perspective view of showing an example of a reaction apparatus, and FIG. 2(*a*), FIG. 2(*b*) and FIG. 2(*c*) are illustration diagrams of showing projected images of toner particles having no corners in FIG. 2(*a*), and of toner particles having corners in FIG. 2(*b*) and FIG. 2(*c*).

It is a feature of the present invention that the method of manufacturing the toner possesses the steps of conducting a polymerization process for acquiring wax-containing polyester resin particles via condensation-polymerization of carboxylic acid and alcohol employing oil droplets after forming such oil droplets, including wax and a polymerizable monomer containing at least one kind of carboxylic acid with divalence or more and at least one kind of alcohol with divalence or more in an aqueous medium containing a surfactant including a compound having a long chain hydrocarbon group and an acidic group, and further conducting a process of coagulating at least the wax-containing polyester particles in the above aqueous medium.

It is also preferable in the method of manufacturing toner of the present invention that the acidic group contained in the surfactant is any one of a sulfonic acid group, a phosphoric acid group and a carboxylic acid group. It is also preferable that concentration of the surfactant contained in the aqueous medium is not more than the critical micelle concentration. It is further preferable that the hydrocarbon group in the compound constituting the surfactant has a carbon number of 8-40.

It is preferred in the method of manufacturing toner of the present invention that the foregoing coagulation process is conducted in the aqueous medium used in the foregoing polymerization process.

It is a feature in the method of manufacturing toner of the present invention that the polymerizable monomer contains at least one kind of carboxylic acid with trivalence or more and/or at least one kind of alcohol with trivalence or more.

It is preferred in the method of manufacturing toner of the present invention that the foregoing wax is selected from the group including at least hydrocarbon based wax, ester based wax, natural product based wax, and amide based wax.

Further, it is a feature that a toner of the present invention is prepared by the foregoing manufacturing method. It is preferable in the present invention that the ratio of toner particles having a shape factor in the range of 1.0-1.6 is at least 65% by number based on the number of all toner particles. It is also preferable that the toner particles have a shape factor variation coefficient of not more than 16 W. It is also preferable that the toner particles have a number variation coefficient in a number particle size distribution of not more than 27 W. It is further preferable that the ratio of colored particles having no corners is at least 50 W by number based on the number of all toner particles.

It is a feature in the present invention that the above-cited toner is used via an image forming method possessing the steps of developing a latent image to be visualized formed on an image carrier with a toner-containing developer, and transferring that toner onto a transfer material.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The toner of the present invention, composed of toner particles prepared by coagulating polyester resin particles with colorant particles, if desired, is a polymerized toner prepared by the toner manufacturing method described below.

<Method of Manufacturing Toner>

Disclosed is the method of manufacturing toner possessing the steps of conducting a polymerization process for acquiring wax-containing polyester resin particles via condensation-polymerization of carboxylic acid and alcohol employing oil droplets under the presence of wax, after forming the oil droplets made of a composite for resin particle formation containing wax and a polymerizable monomer composed of at least one kind of carboxylic acid with divalence or more (hereinafter referred to as polycarboxylic acid) and at least one kind of alcohol with divalence or more (hereinafter referred to as polyalcohol) in an aqueous medium containing a surfactant including a compound having a long chain hydrocarbon group and acidic group (hereinafter referred to also as acidic group-containing surfactant), and conducting a coagulation process of acquiring colored particles by coagulating at least the wax-containing polyester particles and colorant particles in the aqueous medium.

Provided as an example of this manufacturing method of toner are processes constituting oil droplet forming process (1): in which a composite for resin particle formation is prepared by mixing the polycarboxylic acid, the polyalcohol and the wax, after which the composite for resin particle formation is dispersed in an aqueous medium containing an acidic group-containing surfactant; polymerization process (2): in which the wax-containing polyester resin particle dispersion is prepared by polymerization-treatment of a water based dispersion of the resulting composite for resin particle formation; coagulation process (3): in which colored particles as toner composition components including the resulting wax-containing polyester resin particles, colorant particles, and wax particles or charge control agent particles if desired are coagulated and fused in the aqueous medium; filtrating/washing process (4): in which the resulting colored particles are filtrated from the aqueous medium, and the surfactant is removed from the colored particles via washing; and drying process (5): in which the colored particles are dried following the washing treatment; and if appropriate, external additive addition process (6): in which external additives are added into the colored particles after drying treatment may be introduced. In addition, though a toner particle constituting toner means a particle in which an external additive is added into a colored particle in the case of conducting external additive treatment, a colored particle itself is a toner particle in the case of conducting no external additive treatment.

Oil Droplet Forming Process (1);

Oil droplets are formed, in which a polymerizable monomer and wax-containing composite made of polycarboxylic acid and polyalcohol for resin particle formation is added into an aqueous medium in which acidic group-containing surfactant of not more than critical micelle concentration is dissolved, and dispersed utilizing mechanical energy.

The homogenizer to disperse oil droplets by mechanical energy is not specifically limited, for example, a stirring apparatus CLEARMIX, manufactured by M-Technique Co., Ltd., having a high speed rotating rotor, a ultrasonic dispersing apparatus, a mechanical homogenizer, Manton-Gaulin homogenizer and a pressure type homogenizer are usable. The number average primary particle diameter of the oil droplets after dispersing is preferably 50-500 nm, and more preferably 70-300 nm.

"Aqueous medium" as described in the present invention means an aqueous medium containing water of at least 50% by weight. Water soluble solvents other than water may be employed as components. Examples of these solvents include methanol, ethanol, isopropanol, butanol, acetone, methyl ethyl ketone, and tetrahydrofuran, of which preferred are alcohol based organic solvents such as methanol, ethanol, isopropanol, and butanol, which do not dissolve the resins.

[Acidic Group-Containing Surfactant]

An acidic group-containing surfactant used in the manufacturing method in the present invention is a compound containing a hydrophobic group composed of a long chain hydrocarbon group and a hydrophilic group composed of acidic groups. "Long chain hydrocarbon group" as described above means a hydrocarbon group structure having a carbon number of 8 or more in the principal chain, this long chain hydrocarbon group is an aromatic hydrocarbon group which may contain an alkyl group having, for example, a carbon number of 8-40 in the principal chain as a substituent, and a phenyl group including an alkyl group having a carbon number of 8-30 in the principal chain is preferably provided.

An acidic group constituting this acidic group-containing a surfactant which exhibits high acidity is preferably employed, of which a sulfonic acid group, a carboxylic acid group, and a phosphoric acid group, as examples, are employed, of which a sulfonic acid group is preferably used. Sulfonic acid, carboxylic acid and phosphoric acid, each possessing a long chain hydrocarbon group are specifically preferable as an example of the acidic group-containing surfactant. Provided as specific examples can be sulfonic acids such as dodecyl sulfonic acid, eicosyl sulfonic acid, decyl benzenesulfonic acid, dodecylbenzenesulfonic acid, as well as eicosyl benzenesulfonic acid, carboxylic acids such as dodecyl carboxylic acid and the like, in addition to phosphoric acids such as dodecyl phosphoric acid and eicosyl phosphoric acid. Compounds of the foregoing sulfonic acids are specifically preferable.

Though the acidic group-containing surfactant can be a surfactant in which an acidic group and a long chain hydrocarbon group are bonded via various inorganic groups and organic groups, it is preferred that the acidic group and the long chain hydrocarbon group are directly bonded. The reason has not yet been determined, however, it is presumed that in an aqueous medium, not only an acidic group is oriented in the aqueous medium (water phase), but also a hydrophobic group is oriented in an oil droplet (oil phase) containing a polymerizable composite via a structure in which a long chain hydrocarbon group as a hydrophobic group and an acidic group as a hydrophilic group are directly bonded, whereby stable oil droplets are acquired and water produced in a condensation-polymerization reaction can effectively be evacuated into the water phase.

It is preferred that concentration of this acidic group-containing surfactant contained in the aqueous medium is not more than the critical micelle concentration. Stable oil droplets can be formed with no micelle formation when concentration of the acidic group-containing surfactant contained in the aqueous medium is not more than the critical micelle concentration. It is also assumed that in the case of stable oil droplet formation, the entire surfactant is appropriately oriented around the oil droplets caused by no excessive amount of surfactant, and the reaction rate of condensation-polymerization can be increased via such an appropriate orientation by assuredly improving a function as a catalyst for dehydration during the condensation-polymerization reaction in a polymerization process described in following polymerization process (2). In general, concentration of an acidic group-containing surfactant contained in the aqueous medium is commonly not more than the critical micelle concentration, specifically at most 80% of the critical micelle concentration, and is preferably at most 70% of critical micelle concentration. However, this is not a limited percentage. The lower limit of an acidic group-containing surfactant content is the content for allowing to function as a catalyst in the condensation-polymerization reaction to polymerize the polyester. Including within this lower limit, the acidic group-containing surfactant content is 0.01-2% by weight, based on the aqueous medium, and preferably 0.1-1.5% by weight.

An anionic surfactant or a nonionic surfactant may appropriately be contained in an aqueous medium to stabilize oil droplets made of a polymerizable monomer and wax-containing composite for resin particle formation.

[Polycarboxylic Acid]

The polycarboxylic acid contained in a polymerizable composite employed in the method of manufacturing toner in the present invention is a carboxylic acid with divalence or more. Provided, for example, are dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecyl succinic acid, n-dodecenyl succinic acid, isododecyl succinic acid, isododecenyl succinic acid, n-octyl succinic acid, and n-octenyl succinic acid; aromatic dicarboxylic acids such as phthalic acid, isophthalic acid, terephthalic acid, and naphthalene dicarboxylic acid; as well as carboxylic acids with trivalence or more such as trimellitic acid, pyromellitic acid, acid anhydrides of these acids, and acid chlorides of these acids. The above polycarboxylic acid can be used singly or in combination of at least two kinds.

In the case of employing carboxylic acids with trivalence or more as the polycarboxylic acid, wax-containing polyester resin particles made of a polyester resin having a cross-linking structure can be acquired via a polymerization process. The content of carboxylic acid with trivalence or more is preferably 0.1-10% by weight, based on the entire polycarboxylic acid amount.

[Polyalcohol]

A polyalcohol contained in a polymerizable composite employed in the method of manufacturing toner in the present invention is alcohol with divalence or more. Provided, for example, are diols such as ethylene glycol, diethylene glycol, triethylene glycol, 1,2-propylene glycol, 1,3-propylene glycol, 1,4-butanediol, 1,4-butylene diol, neopentylglycol, 1,5-pentane glycol, 1,6-hexane glycol, 1,7-heptane glycol, 1,8-octanediol, 1,9-nonane diol, 1,10-decane diol, pinacol, cyclopentane-1,2-diol, cyclohexane-1,4-diol, cyclohexane-1,2-diol, cyclohexane-1,4-dimethanol, dipropylene glycol, polyethylene glycols, polypropylene glycol, polytetramethylene glycol, bisphenol A, bisphenol Z, and hydrogen-added bisphenol A; aliphatic polyalcohols with trivalence and more such as glycerin, trimethylol ethane, trimethylol propane, pentaerythritol, sorbitol, trisphenol PA, phenol novolac, and cresol novolac; as well as alkylene oxide addition products of the foregoing aliphatic polyalcohol with trivalence and more. The polyalcohol can be used singly or in combination of at least two kinds.

In the case of employing aliphatic polyalcohol with trivalence or more, or its alkylene oxide addition product as the polyalcohol, wax-containing polyester resin particles made of a polyester resin having a cross-linking structure can be acquired via a polymerization process. The content of aliphatic polyalcohol with trivalence or more, or its alkylene oxide addition product is preferably 0.1-10% by weight, based on the entire polyalcohol amount.

In view of the ratio of the above-mentioned polyalcohol to polycarboxylic acid, an equivalent ratio of [OH]/[COOH] is preferably 1.5/1-1/1.5, and more preferably 1.2/1-1/1.2, where [OH] indicates hydroxyl groups in the polyalcohol, and [COOH] indicates carboxyl groups in the polycarboxylic acid. Polyester resin having a desired molecular weight can be assuredly acquired by arranging to set the ratio of polyalcohol to polycarboxylic acid in the above range.

The glass transition point and softening point of polyester resin obtained via condensation-polymerization treatment of polycarboxylic acid and polyalcohol are preferably selected to be 20-90° C. and 80-220° C., respectively, and more preferably 35-65° C. and 80-150° C., respectively. The glass transition point is determined employing an on-setting technique when increasing the temperature in the second trial via a differential thermal analysis method, while the softening point can be determined employing a ½ method of an elevated type flow tester.

The polycarboxylic acid and the polyalcohol as well as a small amount of monovalent carboxylic acid and/or monovalent alcohol can be contained in the polymerizable composite. Such the monovalent carboxylic acid or the monovalent alcohol functions as a polymerization terminating agent in the condensation-polymerization reaction for the oil droplets, whereby the molecular weight of obtained polyester resin, depending on the added amount can be adjusted.

[Wax]

It is preferred that wax contained in a composite for resin particle formation employed in a toner manufacturing method of the present invention is selected from the group including at least hydrocarbon based wax, ester based wax, natural product based wax and amide based wax.

Examples of hydrocarbon based wax include a low molecular weight polyethylene wax, a low molecular weight polypropylene wax, a microcrystalline wax, a Fischer-Tropsch wax and a paraffin wax. Examples of ester based wax are ester made of higher fatty acid and higher alcohol, and so forth specifically including ethyleneglycol stearic acid ester, ethyleneglycol behenic acid ester, neopentylglycol stearic acid ester, neopentylglycol behenic acid ester, 1.6-hexanediol stearic acid ester, 1.6-hexanediol behenic acid ester, glycerin stearic acid ester, glycerin behenic acid ester, pentaerythritol stearic acid ester, pentaerythritol behenic acid ester, citric acid stearyl, citric acid behenyl, malic acid stearyl and malic acid behenyl. Examples of natural product based wax include carnauba wax, bees wax, snow wax and others. These can also be used singly or in combination of at least two kinds.

The content of wax is typically 2-30% by weight, based on the total composite for resin particle formation, preferably 3-25%, and more preferably 4-20% by weight.

[Organic Solvent]

The composite for resin particle formation used in the method of manufacturing toner in the present invention may contain various oil-soluble components such as organic solvents. Provided as such the organic solvent, for example, may be toluene, ethyl acetate, and others, which exhibit low water-solubility in addition to a low boiling point.

The composite for resin particle formation used in the manufacturing method of toner in the present invention may contain colorants. Wax-containing polyester resin particles colored in advance can be acquired via polymerization, employing a composite containing colorants for resin particle formation.

Polymerization Process (2);

Wax-containing polyester resin particles are acquired in a polymerization process via condensation-polymerization of polycarboxylic acid and polyalcohol with oil droplets dispersed in an aqueous medium in the oil droplet forming process.

According to this polymerization process, the hydrophilic group composed of acidic groups and the hydrophobic group composed of a long chain hydrocarbon group in the acidic group-containing surfactant on the surface of formed oil droplets are oriented in the water phase and in the oil phase, respectively. It is assumed that water produced in a condensation-polymerization reaction can be removed from the oil droplets by employing the acidic group existing on the boundary surface between this oil droplet and water phase as a catalyst for dehydration, and as a result, the condensation-polymerization reaction together with oil droplets in the aqueous medium is promoted.

Depending on kinds of the multivalent calboxylic acid and the polyalcohol contained in the composite for resin particle formation, the polymerization temperature to conduct condensation-polymerization treatment is usually not less than 40° C., preferably 50-150° C., and more preferably 50-100° C. in view of treatment at a target temperature below the boiling point of water in the aqueous medium. Depending on the reaction rate of condensation-polymerization to form wax-containing polyester resin particles, the reaction time of polymerization is typically 4-10 hours.

The weight average molecular weight (Mw) of wax-containing polyester resin particles prepared via the polymerization process is not less than 10,000, preferably 20,000-10,000,000, and more preferably 30,000-1,000,000. These values are determined employing gel permeation chromatography (GPC). In the case of a weight average molecular weight of less than 10,000, a problem of an off-setting phenomenon at high temperature may be produced in the fixing process for an image formation operation employing the toner. A number average molecular weight (Mn) of these wax-containing polyester resin particles is at most 20,000, preferably 1,000-10,000, and more preferably 2,000-8,000. These values are determined employing gel permeation chromatography (GPC). In the case of a number average molecular weight exceeding 20,000, neither fixability at low temperature in a fixing process for an image formation operation employing the toner, nor desired glossiness of images acquired via image formation when the color toner is used can also be obtained.

Coagulation Process (3);

Based on the coagulation process, a coagulation dispersion is prepared by mixing a dispersion of wax-containing polyester resin particles obtained via above-mentioned polymerization process (2) and a dispersion of colorant particles or that of wax particles, charge control agent particles, or toner constituent particles if desired, and wax-containing polyester resin particles, colorant particles and such are coagulated and fused in the aqueous medium to form a colored particle dispersion.

The salting-out treatment is conducted by adding coagulants having a concentration of at least the critical coagulation concentration into the coagulation dispersion, and simultaneously stirring them in a reaction apparatus (refer to FIG. 1) equipped with stirring blades described later in a stirring mechanism, while the heat-fusing treatment is conducted at a temperature higher than the glass transition point of the wax-containing polyester resin particles. Then, while forming coagulated particles, the particle diameter is allowed to gradually increase, when the particle diameter reaches the desired value, particle growth is stopped by adding a relatively large amount of water, and the resulting particle surface is smoothed via further heating and stirring, to control the shape to form colored particles. Further, herein, coagulants as well as organic solvents, which are infinitely soluble in water, may be simultaneously added into the coagulation dispersion. Also provided, for example, can be coagulation aids such as calcium hydroxide, soda ash, bentonite, fly ash, and kaolin.

Coagulants to be employed are not specifically limited, but coagulants selected from metal salts are preferable. Examples of specific metal salts include a salt of monovalent metal such as sodium, potassium, or lithium, a salt of divalent metal such as calcium, magnesium, or copper, and a salt of trivalent metal such as aluminum and the like. Examples of specific salts include sodium chloride, potassium chloride, lithium chloride, calcium chloride, magnesium chloride, zinc chloride, copper sulfate, magnesium sulfate, and manganese sulfate. Of these, a salt of divalent metal is most preferable. In the case of using the salt of divalent metal, the coagulation process can be achieved with only a small amount of coagulants. These can also be used singly or in combination of at least two kinds.

These coagulants are preferably added into the coagulation dispersion in an amount higher than the critical coagulation concentration. The added amount is preferably at least 1.2 times that of the critical coagulation concentration, and more preferably at least 1.5 times. The critical coagulation concentration, as described here, refers to an index regarding the stability of water based dispersion and concentration at which coagulation occurs through the addition of coagulants. The critical coagulation concentration varies depending on the dispersed particle components. The critical coagulation concentration is described in, for example, Seizo Okamura, et al., "Kobunshi Kagaku (Polymer Chemistry) 17, 601 (1960) edited by Kobunshi Gakkai, and other publications. Based on such publications, it is possible to obtain detailed critical coagulation concentration data. Further, as another method, a specific salt is added to a targeted particle dispersion while varying the concentration of the salt; the ξ potential of the resulting dispersion is measured, and the critical coagulation concentration is also determined as the concentration at which the ξ potential value varies.

Those solvents which do not dissolve a formed polyester resin are selected as organic solvents infinitely soluble in water. Specifically listed may be methanol, ethanol, 1-propanol, 2-propanol, ethylene glycol, glycerin, acetone, and the like, but alcohol of at most 3 in carbon number such as methanol, ethanol, 1-propanol, or 2-propanol is preferable, and 2-propanol is specifically more preferable. The added amount of the infinitely soluble organic solvents in this water is preferably 1-100% by volume, based on the coagulation dispersion into which coagulants are added.

In the coagulation process, the period of standing time after addition of coagulants is preferred to be as short as possible. Namely, it is preferable that the coagulation dispersion is heated as quickly as possible after addition of coagulants, and then heated to at least the glass transition temperature of the wax-containing polyester resin particles or higher. The reason why this is most effective has not yet been determined. However, problems may be produced, in which the state of coagulated particles varies depending on the elapsed standing time, whereby an unstable particle diameter distribution of the resulting toner particles possibly occurs and the surface condition tend to fluctuate. The standing time is commonly within 30 minutes, and is preferably within 10 minutes. The temperature, at which coagulants are added, is not specifically limited, but preferably the glass transition temperature of wax-containing polyester resin particles or less.

Further, it is preferred that in the coagulation process, the temperature is quickly increased via heating, and the rate of temperature increase is preferably at least 1° C./minute. There is specifically no upper limit in a rate of temperature increase, but the rate of temperature increase is preferably at most 15° C./minute in view of inhibiting coarse grain formation caused by the accelerated fusing process. After the coagulation dispersion is also heated to the glass transition temperature or more, it is important to continuously conduct the fusing process while maintaining the coagulation dispersion temperature for the duration of the process. By this, the step of grown colored particles (coagulation of wax-containing polyester resin particles and colorant particles) and the step of fusing (disappearance of a boundary between particles can be effectively accelerated, whereby durability of the resulting toner can be enhanced.

[Colorants]

The colorant particle dispersion can be prepared by dispersing colorants in an aqueous medium. The dispersion process of colorants is desired to be conducted with the surfactant concentration being not less than the critical micelle concentration, since colorants are evenly dispersed. Apparatuses employed for colorant dispersion treatment are not specifically limited, but those used in foregoing oil droplet forming process (1) can be provided. Surfactants utilized here are not also limited, but the following anionic surfactants can preferably be employed.

Provided as anionic surfactants are sulfonic acid salts such as sodium dodecylsulfonate, sodium dodecylbenzenesulfonate, sodium arylalkyl polyethersulfonate, sodium 3,3-disulfondiphenylurea-4,4-diazo-bis-amino-8-naphthol-6-sulfonate, sodium 2,2,5,5-tetramethyl-triphenylmethane-4,4-diazi-bis-β-naphthol-6-sulfonate and the like, sulfuric acid salts such as sodium dodecylsulfonate, sodium tetradecylsulfonate, sodium pentadecylsulfonate, sodium octylsulfonate and the like, and fatty acid salts such as sodium oleate, sodium laureate, sodium caprate, sodium caprylate, sodium caproate, potassium stearate, calcium oleate and the like.

Carbon black, magnetic materials, dyes and pigments can optionally be employed as colorants, and channel black, furnace black, acetylene black, thermal black, lamp black and the like can be used as carbon black. Also employed can be Ferromagnetic metals such as iron, nickel, cobalt, alloys containing these metals, ferromagnetic compounds such as ferrite and magnetite, and alloys with no ferromagnetic metal exhibiting ferromagnetic properties under heat treatment, such as so-called Heusler alloys of a manganese-copper-aluminum alloy and a manganese-copper-tin alloy, and chromium dioxide.

Employed as dyes may be C.I. Solvent Red 1, the same 49, the same 52, the same 63, the same 111, and the same 122; C.I. Solvent Yellow 19, the same 44, the same 77, the same 79, the same 81, the same 82, the same 93, the same 98, the same 103, the same 104, the same 112, and the same 162; C.I. Solvent Blue 25, the same 36, the same 60, the same 70, the same 93, the same 95, and others as appropriate, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, and the same 222, C.I. Pigment Orange 31, and the same 43; C.I. Pigment Yellow 14, the same 17, the same 93, the same 94, and the same 138; C.I. Pigment Green 7; C.I. Pigment Blue 15:3, the same 60, and mixtures thereof may be employed. The number average primary particle diameter varies widely depending on type, but is commonly 10-200 nm.

Employed as charge control agents constituting charge control agent particles may also be various types of those which are known in the art and which can be dispersed in an aqueous medium. Specifically listed are nigrosine based dyes, metal salts of naphthenic acid or higher fatty acids, alkoxylated amines, quaternary ammonium salts, azo based metal complexes, salicylic acid metal salts or metal complexes thereof. Further, it is preferable that the number average primary particle diameter of the charge control agent particles is roughly between 10 and 500 nm in the dispersed state.

[Reaction Apparatus]

In the case of toner composed of toner particles prepared via coagulation and fusion of wax-containing polyester resin particles, it is also possible to form toner having a targeted shape factor and a highly uniform shape distribution, by using stirring blades and a stirring tank which can create a flow in a reaction apparatus to be a laminar flow and can uniform inner temperature distribution, and by controlling the temperature, the number of revolutions and the duration of the coagulation process. The reason why toner having a highly uniform shape distribution can be produced is as follows: when the coagulation process is conducted in the field where a laminar flow has been formed, intensive stress is not applied to coagulated particles to which coagulation and fusion have been accelerated, and temperature distribution in the stirring tank is uniform in the accelerated laminar flow, whereby the shape distribution of coagulated particles becomes presumably uniformized. Further, the coagulated particles are gradually changed into spheres via the shape controlling process of heating and stirring, thus, the resulting colored particle shape can be optionally controlled.

The stirring blades and stirring tank employed during the production of toner composed of colored particles prepared via coagulation and fusion of wax-containing polyester resin particles are shown in FIG. 1, being as a preferable example. The reaction apparatus is characterized in that the stirring blades are arranged at multiple levels in which the upper stirring blade is arranged so as to have a crossed axis angle α preceding in the rotation direction with respect to the lower stirring blade, and obstacles such as a baffle plate and the like, which form a turbulent flow, are not employed.

In the reaction apparatus illustrated in FIG. 1, rotating shaft 3 is installed vertically in the center of vertical type cylindrical stirring tank 2, the exterior is equipped with heat exchange jacket 1, and rotating shaft 3 is provided with lower level stirring blade 4*b* installed near the bottom of stirring tank 2 and upper level stirring blade 4*a*. Upper level stirring blade 4*a* is arranged with respect to lower level stirring blade 4*b* at crossed axis angle α preceding in the rotation direction. Further, in FIG. 1, an arrow shows the rotation direction, numerals 7 and 8 designate upper material charging inlet and lower material charging inlet, respectively.

When the toner of the present invention is prepared, crossed axis angle α of stirring blades 4*a* and 4*b* is preferably less than 90 degrees. The lower limit of crossed axis angle α is not particularly limited, but it is preferably between 50 and 90°, but more preferably between 10° and 90°. By employing the constitution as above, it is assumed that, firstly, the coagulation dispersion is stirred employing stirring blade 4*a* provided at the upper level, whereby a downward flow is formed. It is also assumed that subsequently, the downward flow formed by upper level stirring blade 4*a* is accelerated by stirring blade 4*b* installed at a lower level, whereby another flow is simultaneously formed by stirring blade 4*a*, and as a whole, accelerating the laminar flow.

The shape of the stirring blades is not particularly limited as long as they do not form a turbulent flow, but rectangular plates as shown in FIG. 1 which are formed of a continuous plane with no through-hole are preferred, and may have a curved plane. By forming a non-turbulent flow of stirring blades, neither coagulation of wax-containing polyester resin particle-to-wax-containing polyester resin particle in the polymerization process is promoted, nor wax-containing polyester resin particles are dispersed again via destruction of resin particles. Excessive collision of the particles can be avoided in the coagulation process, thus evenness of the particle diameter distribution can also be enhanced, so that toner exhibiting a uniform particle diameter distribution results. Excessive coagulation of the particles can be controlled, so that toner exhibiting a uniform shape distribution can also be obtained.

Filtrating/Washing Process (4);

In the filtrating/washing process, carried out are a filtrating process of segregating colored particles from the colored particle dispersion obtained by the above coagulation process, and a washing process of removing adhered materials such as surfactants, coagulants and the like from filtrated colored particles (also known as caked aggregation). Herein, filtrating treatment methods are not particularly limited, but include a centrifugal separation method, a vacuum filtration method employing a Buchner funnel, a filtration method employing a filter press, and so forth.

Drying Process (5);

The washed colored particles are then subjected to a drying process. Provided as a dryer used in this process is a spray dryer, a vacuum-freeze dryer or a vacuum dryer. The moisture content of dried colored particles is preferably at most 1.0% by weight, but more preferably at most 0.5% by weight.

The moisture content of colored particles can be measured by the Karl-Fischer method. The moisture content measured after standing for 24 hours at a high-temperature and humidity of 30° C. and 85% RH is set to the moisture content of the colored particles, employing moisture content measuring apparatus AQS-724, manufactured by Hiranuma Sangyo Co., Ltd. which is used for samples specifically under a high-temperature and humidity condition of 30° C. and 85% RH and under a heating condition of samples at 110° C.

Further, when dried colored particles coagulate due to weak inter-particle attractive forces, aggregates may be subjected to pulverization treatment. Herein, employed as pulverization devices may be mechanical pulverization devices such as a jet mill, a HENSCHEL MIXER, a coffee mill, a food processor, and the like.

External Additive Addition Process (6);

This external additive addition process is to be carried out to improve fluidity, chargeability, and the cleaning property of dried colored particles. Provided as devices to add external additives, may be various types of commonly known mixing devices such as a tubular mixer, a HENSCHEL MIXER, a Nauter mixer, a V-type mixer, and the like.

External additives are not particularly limited, and various inorganic particles, organic particles, and lubricants can be utilized. Inorganic oxide particles such as silica, titania, alumina and the like are preferably employed as inorganic particles, and further these inorganic particles are preferably subjected to hydrophobic treatment employing a silane coupling agent or a titanium coupling agent. The degree of hydrophobic treatment is not specifically limited, but a range of 40-95 in methanol wettability is preferable. "Methanol wettability" means wettability measured against methanol. In this method, 0.2 g of targeted inorganic particles is weighed and added into 50 ml of distilled water charged into a 200 ml beaker. Methanol is slowly dripped from a burette, the top of which is immersed into the liquid, until the entire inorganic particles become wet while stirring slowly. The degree of hydrophobicity can be calculated by the following equation when the amount of methanol required to make inorganic particles completely wet is a ml.

$$\text{Degree of hydrophobicity}=[a/(a+50)]\times 100 \qquad \text{Formula 1}$$

The addition amount of these external additives is 0.1-5.0% by weight but preferably 0.5-4.0% by weight, based on the toner. External additives may also be used in combination with various appropriate substances.

[Shape Factor of Toner]

Regarding toner particles acquired via the foregoing manufacturing method, the ratio of toner particles having a shape factor being in the range of 1.0-1.6 is preferably at least 65% by number, based on the number of all toner particles, and more preferably at least 70% by number based on the number of all toner particles. When the ratio of toner particles having a shape factor in the range of 1.0-1.6 is at least 65% by number, fixability is improved by increasing packing density of toner particles in the toner layer, transfer-formed onto the transfer material, whereby no occurrence of an off-setting phenomenon is generated. Toner particles are less likely to be crushed, whereby not only charge providing members are less stained, but also chargeability of the toner is more stabilized.

As used herein, the term "shape factor" refers to the value represented by following formula 2, andrepresents the degree of roundness of toner particles.

$$\text{Shape factor}=[(\text{maximum diameter}/2)^2\times\pi]/\text{projected area} \qquad \text{Formula 2}$$

where the maximum diameter refers to the width of particles which is determined in such a manner that when the projected image of the toner particle onto a plane is interposed by two parallel lines, the resulting width of the parallel lines reaches a maximum value, and the projected area refers to the area of the projected image of a toner particle onto a plane. The shape factor is determined in such a manner that images of toner particles magnified at a factor of 2,000 employing a scanning electron microscope are observed, and the resulting images are subjected to photographic image analysis employing a "SCANNING IMAGE ANALYZER" (produced by JEOL, Ltd.). At that time, 100 random toner particles are employed and the shape factor is determined via Formula 2.

The method of controlling this shape factor is particularly not limited, and a stirring process followed by foregoing coagulation process (3), while heating with the circulating flow added by a reaction apparatus, can be utilized.

[Variation Coefficient in Shape Factor]

Regarding the toner prepared via the above-mentioned manufacturing method, the variation coefficient in the shape factor is preferably at most 16%, and more preferably at most 14%. When the variation coefficient in the shape factor is not more than 16%, fixability is improved by reduced voids in the transfer-formed toner layer (powder layer), whereby no occurrence of an off-setting phenomenon may be generated. The charge amount distribution also becomes sharper, whereby a transfer efficiency and the resulting images are enhanced.

The variation coefficient in the shape factor of toner is calculated with following Formula 3:

$$\text{Variation coefficient}=(S_1/K)\times 100 \qquad \text{Formula 3}$$

where $S_1$ represents a standard deviation of the shape factor of 100 random toner particles and K represents an average value of the shape factor.

In order to control the shape factor as well as the variation coefficient in the shape factor with minimal fluctuation of production lots uniformly, the optimal finishing time of processes may be determined while monitoring the coagulated particle properties during the coagulation process of polyester resin particles. "Monitoring" as described herein means that measurement devices are installed in-line, and process conditions are controlled based on measured results. In other words, a shape measuring device is installed in-line, whereby the shape and the particle diameter are measured while successively sampling during the coagulation process, and the reaction is terminated when the targeted shape is achieved. Monitoring methods are not particularly limited, but a flow system particle image analyzer FPIA-2000, (manufactured by Sysmex Corporation) can be used. This analyzer is preferably used because real-time image processing can be conducted while passing through a sample composition, whereby the shape can also be monitored. Namely, a pump is employed from the reaction location, monitoring is constantly performed to measure the shape and so forth, and the reaction can be terminated at when the desired shape is achieved.

[Number Variation Coefficient of Toner]

Regarding the toner prepared via the above manufacturing method, the number particle size distribution of toner is preferably at most 27%, but more preferably at most 25%. In the case of the number particle size distribution of not more than 27%, fixability is improved by reducing voids in the transfer-formed toner layer (powder layer), whereby no occurrence of the off-setting phenomenon may be generated. The charge amount distribution also becomes sharper, whereby the transfer efficiency, as well as the resulting images are improved.

The number particle size distribution as well as the variation coefficient can be determined employing Multisizer 3 (manufactured by Beckman Coulter Co., Ltd.). Employed in this invention was Multisizer 3 connected to a computer installing a software intended for exclusive use with data acquisition and processings, which output the particle size distribution. A 100 μm aperture was used for the above Multisizer 3, and the volume and the number of particles having a diameter of at least 2 μm were measured to calculate the size distribution as well as the number average particle diameter. The number particle size distribution, as described herein, represents the relative frequency of toner particles to a specified particle diameter, and the number average particle diameter, as described herein, expresses the median diameter in the number particle size distribution.

The variation coefficient of the number particle size distribution of a toner can be calculated employing following Formula 4.

$$\text{Number variation coefficient}=(S_2/D_n)\times 100\ (\%) \qquad \text{Formula 4}$$

where $S_2$ represents the standard deviation in the number particle size distribution, and $D_n$ represents the number average particle diameter (in μm).

Methods to control the number variation coefficient are not particularly limited. For example, employed may be a method in which toner particles are classified employing a forced air flow. However, in order to further decrease the number variation coefficient, classification in liquids is also effective. In this liquid classification method, a centrifuge is employed so that toner particles are classified while controlling the rotation speed via differences in sedimentation velocity due to differences in the toner particle diameter.

[Ratio of Toner Particles having no Corners by Number]

Regarding the toner acquired via the above manufacturing method, colored particles having no corners preferably account for at least 50% by number, based on the colored particles constituting toner, and more preferably at least 70% by number.

When colored particles having no corners preferably account for at least 50% by number, fixability is improved by reducing voids in the transfer-formed toner layer (being a powder layer), whereby no occurrence of an off-setting phenomenon in a fixing process is generated. The formation of colored particles exhibiting resistance to crushing and abrasion as well as colored particles possessing charge-concentrating portions is minimized, and the charge amount distribution becomes sharper, whereby transfer efficiency can be stabilized to form excellent images over a long period of duration.

Figure 2:
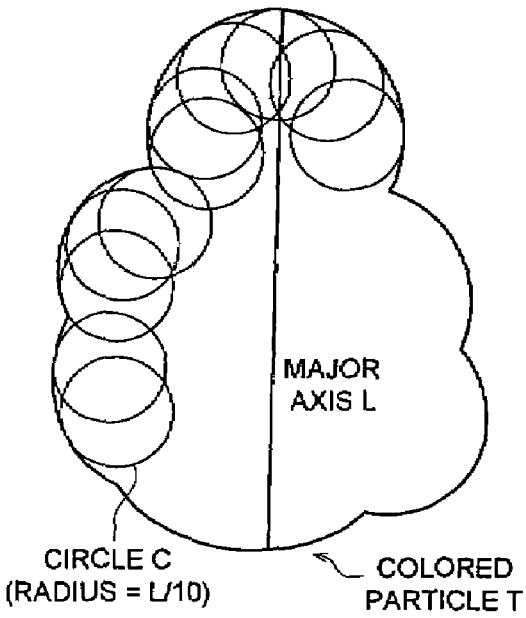
Figure 2:
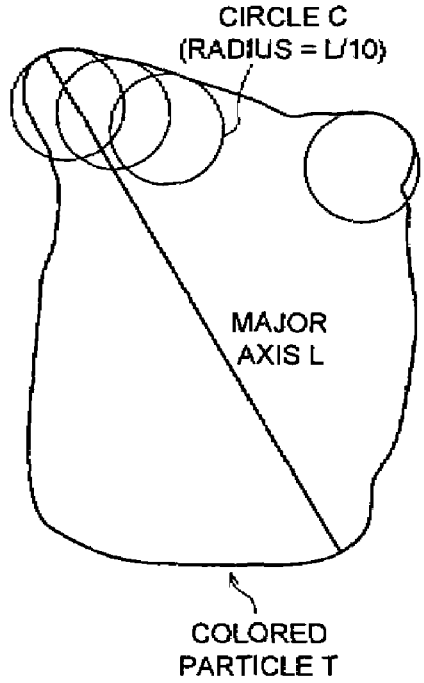
Figure 2:
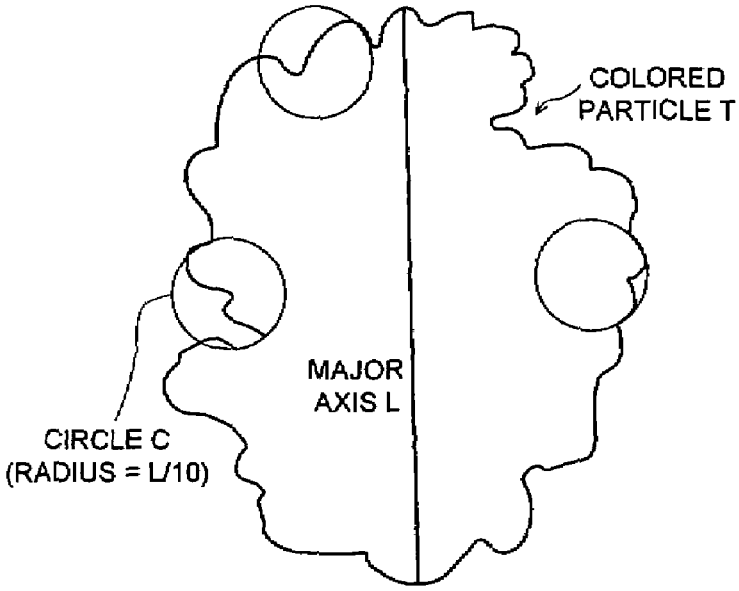

Colored particles having no corners, as described herein, refer to those having substantially no projections on which charges tend to concentrate or which tend to be worn down by stress. Namely, as shown in FIG. 2(*a*), the major axis of colored particle T is designated as L. Circle C, having a radius of L/10, which is positioned within periphery of colored particle T, is rolled along inside the periphery of colored particle T, while being in contact with the circumference. When it is possible to roll any part of the circle without substantially crossing over the interior circumference of colored particle T, a colored particle is designated as "a colored particle having no corners". The expression, "without substantially crossing over the circumference" means that there is at most only one projection at which any part of the rolled circle crosses over the circumference. Further, "the major axis of a colored particle" as described herein refers to the maximum dimension of the colored particle when the projection image of the colored particle onto a flat plane is placed between two parallel lines. Incidentally, FIGS. 2(*b*) and 2(*c*) show the projection images of a colored particle having corners.

In order to measure the proportion of colored particles having no corners, the image of a magnified toner particle is first observed employing a scanning electron microscope. The resulting image of the toner particle is further magnified to obtain a photographic image at a magnification factor of 15,000. Subsequently, employing the resulting photographic image, the presence or absence of corners is determined by drawing a colored particle image in addition to neglecting external additives in cases when these external additives are present. This measuring operation is carried out for 100 random toner particles.

Methods for preparing colored particles having no corners are not specifically limited. Coagulated particle surface, for example, is markedly uneven and has not been smoothed at the wax-containing polyester resin particle coagulation terminating stage. However, by optimizing conditions during the shape controlling process such as temperature, rotation speed of stirring blades, stirring time, and the like, it is possible to prepare colored particles having no corners. These conditions can vary, depending on the physical properties of the wax-containing polyester resin particles. For example, by setting a temperature higher than the glass transition point of the wax-containing polyester resin particles, as well as employing a higher rotation frequency, the particle surface is smoothened. Thus it is possible to form colored particles having substantially no corners.

[Toner Particle Diameter]

Regarding the toner prepared via the above method, the toner particle diameter is preferably 3-8 μm in median diameter in terms of volume. It is possible to control this toner particle diameter via utilizing coagulant concentration during the coagulation process, the added amount of organic solvents, the fusing time, or further, composition of the polyester resin. Further, in the case of a median diameter of 3-8 μm in terms of volume, toner particles exhibiting an enhanced adhesive force, generating an off-setting phenomenon via extreme adhesion to a heating member in the fixing process, are reduced, so that transfer efficiency enhances halftone image quality as well as fine line and dot image quality. Incidentally, the median diameter in terms of volume is measured in the measuring range of 1-20 μm employing "Multisizer 3" (manufactured by Beckman Coulter Co., Ltd.) having an aperture of 50 μm.

<Developer>

The toner of the present invention is used as a single-component magnetic toner-containing magnetic material, or as a two-component developer mixed with a so-called carrier, and a non-magnetic toner may be used singly. Though any one of them can preferably be used, it is preferred to use as a two-component developer mixed with a carrier.

Magnetic particles composed of commonly known materials such as a metal of iron, ferrite or magnetite, and alloys of the above metal with aluminum or lead can be employed as the carrier constituting a two-component developer, of which ferrite particles are preferable. The median diameter of a carrier used in the two-component developer is preferably 15-100 μm in terms of volume, and more preferably 25-60 μm. The median diameter in terms of volume can be determined, for example, employing a laser diffraction type particle size distribution measurement apparatus equipped with a wet homogenizer, "HELOS" (available from SYMPATEC Co.). Examples of preferred carriers include a resin-coated carrier and a so-called resin dispersion type carrier in which magnetic particles are dispersed in resin. The resin composition used for coating is not specifically limited and examples thereof include an olefin based resin, a styrene based resin, a styrene-acryl based resin, a silicone based resin, an ester based resin and a fluorinated polymer based resin. Resins used for the resin dispersion type carrier are not specifically limited and commonly known resins are usable. Examples thereof include a styrene-acryl resin, a polyester resin, a fluorinated resin and a phenol resin.

<Developing Process>

Developing processes in which the toner of the present invention can be used are not particularly limited. Provided may be a process employing a two-component developer mixed with so-called "carrier", a process of employing a single-component developer for which the toner is used singly, but any one of them can be used as appropriate. In addition, the toner of the present invention exhibits a sharp charge amount distribution as well as no variation in toner characteristics.

An alternating electric field is preferably applied between a developer carrier and a latent image carrier in a usable developing device. It is preferred that parameters of this alternating electric field include alternating current frequency f of 200-8000 Hz and a peak-to-peak voltage vpp of 500-3000 V.

<Image Forming Methods>

The image forming method in the present invention includes a process of transferring the toner onto a transfer material, after a latent image, to be visualized, formed on a latent image carrier is developed with a developer containing the toner of the present invention. Specifically, a toner image is obtained by electrostatically actualizing a toner latent image formed on the latent image carrier employing the developer in a developing process with a non-contact developing technique, and this toner is then transferred via application of transfer electric field, whereby a visualized image can be subsequently acquired by fixing the transferred toner image to a transfer material in a fixing process, to be described later.

<Fixing Process>

Suitable fixing processes usable in the present invention include a so-called contact heating technique. Specific examples for fixing via the contact heating technique include particularly a heat-press fixing technique, a heat roller fixing technique, and a pressing contact heat-fixing technique in which a rotary heating member including a fixed heating body is used.

In the fixing process with a heat roller fixing technique, provided is a fixing unit which is composed of an upper roller equipped with a interior heat source in an iron or aluminum cylinder coated on the cylinder surface with fluorinated resin and such, and a lower roller made of silicone rubber and the like. A line heater is employed as a heat source, and the surface temperature of the upper roller is increased to approximately 120-200° C. Pressure is applied between the upper roller and the lower roller, and the lower roller is deformed by this pressure, whereby a so-called nip is formed at this deformed portion. The nip width is 1-10 mm, and preferably 1.5-7 mm. The line speed of fixing is preferably 40-600 mm/sec. When the nip width is too small, heat can not be uniformly transferred to the toner, resulting in uneven fixing. On the other hand, when the nip width is too large, melting of polyester resin contained in toner particles is accelerated, resulting in the offsetting phenomenon during the fixing process.

A cleaning system may be provided to a fixing unit. Provided as a cleaning system can be a system of supplying silicone oil to the upper roller or a system of cleaning the upper roller with a pad, roller, or web impregnated with silicone oil. In addition, polydimethyl siloxane, polymethylphenyl siloxane, polydiphenyl siloxane, and such may be used as the silicone oil. Further, fluorine-containing siloxane is also preferable.

The embodiments of the present invention have been explained, but the present invention is not limited to the foregoing embodiments, and various changes may be added.

EXAMPLE

The following examples will be explained to confirm the effect of the present invention, but the present invention is not limited to these examples.

Wax-Containing Polyester Resin Particle Preparation Example 1

Azelaic acid of 32 g (0.139 mol) and 1,10-decanediol of 28 g (0.139 mol) and pentaerythritol tetrabehenic acid ester of 6 g were heated up to 95° C. These were added into an aqueous solution of 240 g containing dodecylbenzenesulfonic acid of 2 g (an acid group-containing surfactant content of 0.83% by weight), and oil droplets were formed via dispersion employing an ultrasonic homogenizer. Next, wax-containing polyester resin particles (1) were prepared by reacting this reaction solution at 95° C. for 24 hours. A weight average molecular weight (Mw), a number average molecular weight (Mn), a glass transition point Tg and a softening point of wax-containing polyester resin particles (1), which were measured by GPC, were 20,000, 10,000, 60° C., and 125° C., respectively, and the size of wax-containing polyester resin particles (1) was 220 nm in number average primary particle diameter.

Wax-Containing Polyester Resin Particle Preparation Example 2

Polyoxyethylene (2,2)-2,2-bis(4-hydroxyphenyl)propane of 22 g (0.054 mol), neopentylglycol of 1.2 g (0.01 mol), terephthalic acid of 10 g and isophthalic acid of 0.6 g (0.064 mol in combination), accompanied with microcrystalline wax of 5 g were heated up to 95° C. These were added into an aqueous solution of 240 g containing dodecylbenzenesulfonic acid of 3 g (an acid group-containing surfactant content of 1.25% by weight), and oil droplets were formed via dispersion employing an ultrasonic homogenizer. Next, wax-containing polyester resin particles (2) were prepared by reacting this reaction solution at 98° C. for 36 hours. A weight average molecular weight (Mw), a number average molecular weight (Mn), a glass transition point Tg and a softening point of wax-containing polyester resin particles (2), which were measured by GPC, were 30,000, 9,000, 52° C., and 117° C., respectively, and the size of wax-containing polyester resin particles (2) was 230 nm in number average primary particle diameter.

Wax-Containing Polyester Resin Particle Preparation Example 3

Polyoxyethylene (2,2)-2,2-bis (4-hydroxyphenyl) propane of 22 g (0.054 mol), neopentylglycol of 1.2 g (0.01 mol), and terephthalic acid of 9.5 g, isophthalic acid of 0.5 g (0.06 mol in combination) and trimellitic acid of 0.5 g (0.002 mol), accompanied with carnauba wax (Refined Carnauba Wax No. 1, produced by Cerarica Noda Co., Ltd.) of 8 g were heated up to 95° C. These were added into an aqueous solution of 240 g containing dodecylbenzenesulfonic acid of 3 g (an acid group-containing surfactant content of 1.25% by weight), and oil droplets were formed via dispersion employing an ultrasonic homogenizer. Next, wax-containing polyester resin particles (3) were prepared by reacting this reaction solution at 95° C. for 24 hours. Weight average molecular weight (Mw), number average molecular weight (Mn), glass transition point Tg and a softening point of wax-containing polyester resin particles (3) which were measured by GPC, were 50,000, 5,000, 56° C., and 120° C., respectively. The size of wax-containing polyester resin particles (3) was 210 nm in number average primary particle diameter.

Wax-Containing Polyester Resin Particle Preparation Example 4

Polyoxyethylene (2,2)-2,2-bis (4-hydroxyphenyl) propane of 22 g (0.054 mol), neopentylglycol of 1.2 g (0.01 mol), and terephthalic acid of 9.5 g, isophthalic acid of 0.5 g (0.06 mol in combination) and trimellitic acid of 0.5 g (0.002 mol), accompanied with Fischer-Tropsch wax of 8 g were heated up to 95° C. These were added into an aqueous solution of 240 g containing dodecylbenzenesulfonic acid of 3 g (an acid group-containing surfactant content of 1.25% by weight), and oil droplets were formed via dispersion employing an ultrasonic homogenizer. Next, wax-containing polyester resin particles (4) were prepared by reacting this reaction solution at 95° C. for 24 hours. A weight average molecular weight (Mw), a number average molecular weight (Mn), a glass transition point Tg and a softening point of wax-containing polyester resin particles (4), which were measured by GPC, were 50,000, 5,000, 56° C., and 120° C., respectively, and the size of wax-containing polyester resin particles (4) was 210 nm in number average primary particle diameter.

Wax-Containing Polyester Resin Particle Preparation Example 5

Wax-containing polyester resin particle (5) was tried to be prepared, similarly to polyester resin preparation example 1, except that dodecylbenzenesulfonic acid of 2 g is replaced by sodium dodecylbenzenesulfonic acid of 2 g, but resin particles were not possible to be obtained because of having no reaction via condensation and polymerization.

Colorant Dispersion Preparation Example 1

Sodium dodecylbenzenesulfonic acid of 1.0 g as an anionic surfactant was dissolved in ion-exchanged water of 30 ml while stirring. While stirring this solution, carbon black REGAL 330R of 7 g, manufactured by Cabot Co., Ltd. was gradually added into this solution, and subsequently the dispersion treatment was conducted employing a mechanical homogenizer CLEARMIX manufactured by M-Technique. Co., Ltd. to prepare a colorant particle dispersion (1) (hereinafter, referred simply to as "colorant dispersion"). When the colorant particle diameter of the resulting colorant dispersion (1) was measured employing a particle size analyzer Microtrac 9340-UPA, manufactured by Honeywell Co., Ltd., it was 92 nm in volume average particle diameter (average particle diameter weighed by volume).

Colorant Dispersion Preparation Example 2

Colorant dispersion (2) was prepared, similarly to the colorant dispersion preparation example 1, except that in the colorant dispersion preparation example 1, carbon black of 7 g was replaced by pigment "C.I. Pigment Yellow 185" of 8 g. When the colorant particle diameter of the resulting colorant dispersion (2) was measured employing a particle size analyzer Microtrac 9340-UPA, manufactured by Honeywell Co., Ltd., it was 87 nm in volume average particle diameter (average particle diameter weighed by volume).

Colorant Dispersion Preparation Example 3

Colorant dispersion (3) was prepared, similarly to the colorant dispersion preparation example 1, except that in the colorant dispersion preparation example 1, carbon black of 7 g was replaced by quinacridone type magenta pigment "C.I. Pigment Red 122" of 8 g. When the colorant particle diameter of the resulting colorant dispersion (3) was measured employing a particle size analyzer Microtrac 9340-UPA, manufactured by Honeywell Co., Ltd., it was 90 nm in volume average particle diameter (average particle diameter weighed by volume).

Colorant Dispersion Preparation Example 4

Colorant dispersion (4) was prepared, similarly to the colorant dispersion preparation example 1, except that in the colorant dispersion preparation example 1, carbon black of 7 g was replaced by phthalocyanine type cyan pigment "C.I. Pigment Blue 15:3" of 7 g. When the colorant particle diameter of the resulting colorant dispersion (3) was measured employing a particle size analyzer Microtrac 9340-UPA, manufactured by Honeywell Co., Ltd., it was 90 nm in volume average particle diameter (average particle diameter weighed by volume).

Colored Particle Preparation Example K1

After wax-containing polyester resin particles (1), ion-exchanged water of 30 g, colorant dispersion (1), and wax dispersion (1) were charged in a reaction vessel (a four mouth flask) equipped with a temperature sensor, a cooling tube, a nitrogen introducing apparatus and a stirrer, and a temperature inside the reaction vessel was adjusted to 30° C., a sodium hydroxide solution of 5N was added into this coagulation dispersion to adjust pH to 10.0. Next, aqueous solution in which magnesium chloride hexahydrate of 1 g was dissolved in ion-exchanged water of 20 ml was added into the resulting solution at 30° C. for 10 min. while stirring. After standing for 1 min., the temperature started to be raised, and this association was conducted for 10 min. to increase the temperature up to 90° C. A homogenizer as shown in FIG. 1 was used for stirring. In this situation, a coagulated particle diameter was measured with a flow system particle image analyzer FPIA-2000 manufactured by Sysmex Corporation. At the time when the number average particle diameter was grown 5.2 μm, particle growth was terminated by adding an aqueous solution in which sodium chloride of 2 g was dissolved in ion-exchanged water of 20 ml. Further, after the shape control was conducted via continuous fusion by heating this solution at 95° C. for 10 hours while stirring, this system was cooled down to 30° C., and pH was adjusted to 2.0 by adding hydrochloric acid. After this, stirring was terminated. Grown particles were filtrated, repeatedly washed with ion-exchanged water of 45° C., and subsequently dried with hot air of 40° C. to prepare colored particles (K1). As to these colored particles (K1), the shape factor, the variation coefficient in the shape factor, the number variation coefficient in a number particle size distribution, and the ratio of colored particles having no corners are shown in Table 1.

Colored Particle Preparation Example K2

Colored particles (K2) were prepared, similarly to the colored particle preparation example K1, except that in the colored particle preparation example K1, wax-containing polyester resin particles (1) were replaced by wax-containing polyester resin particles (2), and particle growth was terminated at the time when the number average particle diameter was grown 5.5 μm by adjusting pH of a dispersion admixture solution to 11.0. As to these colored particles (K2), the shape factor, the variation coefficient in the shape factor, the number variation coefficient in a number particle size distribution, and the ratio of colored particles having no corners are shown in Table 1.

Colored Particle Preparation Example K3

Colored particles (K3) were prepared, similarly to the colored particle preparation example K1, except that in the colored particle preparation example K1, wax-containing polyester resin particles (1) were replaced by wax-containing polyester resin particles (3), and particle growth was terminated at the time when the number average particle diameter was grown 5.5 μm by adjusting pH of a dispersion admixture solution to 10.5. As to these colored particles (K3), the shape factor, the variation coefficient in the shape factor, the number variation coefficient in a number particle size distribution, and the ratio of colored particles having no corners are shown in Table 1.

Colored Particle Preparation Example K4

Colored particles (K4) were prepared, similarly to the colored particle preparation example K1, except that in the colored particle preparation example K1, wax-containing polyester resin particles (1) were replaced by wax-containing polyester resin particles (4), and particle growth was terminated at the time when the number average particle diameter was grown 5.5 μm by adjusting pH of a dispersion admixture solution to 10.5. As to these colored particles (K4), the shape factor, the variation coefficient in the shape factor, the number variation coefficient in a number particle size distribution, and the ratio of colored particles having no corners are shown in Table 1.

Colored Particle Preparation Example K5

Colored particles (K5) were prepared, similarly to the colored particle preparation example K1, except that an anchor type homogenizer was employed as a homogenizer in the colored particle preparation example K1. As to these colored particles (K5), the shape factor, the variation coefficient in the shape factor, the number variation coefficient in a number particle size distribution, and the ratio of colored particles having no corners are shown in Table 1.

Colored Particle Preparation Example Y1

Colored particles (Y1) were prepared, similarly to the colored particle preparation example K1, except that in the colored particle preparation example K1, colorant dispersion (1) was replaced by colorant dispersion (2), and particle growth was terminated at the time when the number average particle diameter was grown 5.5 μm. As to these colored particles (Y1), the shape factor, the variation coefficient in the shape factor, the number variation coefficient in a number particle size distribution, and the ratio of colored particles having no corners are shown in Table 1.

Colored Particle Preparation Example Y2

Colored particles (Y2) were prepared, similarly to the colored particle preparation example K2, except that in the colored particle preparation example K2, colorant dispersion (1) was replaced by colorant dispersion (2), and particle growth was terminated at the time when the number average particle diameter was grown 5.4 μm by adjusting pH of a dispersion admixture solution to 9.0. As to these colored particles (Y2), the shape factor, the variation coefficient in the shape factor, the number variation coefficient in a number particle size distribution, and the ratio of colored particles having no corners are shown in Table 1.

Colored Particle Preparation Example Y3

Colored particles (Y3) were prepared, similarly to the colored particle preparation example K4, except that in the colored particle preparation example K4, colorant dispersion (1) was replaced by colorant dispersion (2), and particle growth was terminated at the time when the number average particle diameter was grown 5.3 μm. As to these colored particles (Y3), the shape factor, the variation coefficient in the shape factor, the number variation coefficient in a number particle size distribution, and the ratio of colored particles having no corners are shown in Table 1.

Colored Particle Preparation Example Y4

Colored particles (Y4) were prepared, similarly to the colored particle preparation example K3, except that in the colored particle preparation example K3, colorant dispersion (1) was replaced by colorant dispersion (2), and particle growth was terminated at the time when the number average particle diameter was grown 5.5 μm. As to these colored particles (Y4), the shape factor, the variation coefficient in the shape factor, the number variation coefficient in a number particle size distribution, and the ratio of colored particles having no corners are shown in Table 1.

Colored Particle Preparation Example Y5

Colored particles (Y5) were prepared, similarly to the colored particle preparation example Y1, except that an anchor type homogenizer was employed as a homogenizer in the colored particle preparation example Y1. As to these colored particles (Y5), the shape factor, the variation coefficient in the shape factor, the number variation coefficient in a number particle size distribution, and the ratio of colored particles having no corners are shown in Table 1.

Colored Particle Preparation Example M1

Colored particles (M1) were prepared, similarly to the colored particle preparation example K1, except that in the colored particle preparation example K1, colorant dispersion (1) was replaced by colorant dispersion (3), and particle growth was terminated at the time when the number average particle diameter was grown 5.5 μm. As to these colored particles (M1), the shape factor, the variation coefficient in the shape factor, the number variation coefficient in a number particle size distribution, and the ratio of colored particles having no corners are shown in Table 1.

Colored Particle Preparation Example M2

Colored particles (M2) were prepared, similarly to the colored particle preparation example K2, except that in the colored particle preparation example K2, colorant dispersion (1) was replaced by colorant dispersion (3), and particle growth was terminated at the time when the number average particle diameter was grown 5.4 μm by adjusting pH of a dispersion admixture solution to 9.0. As to these colored particles (M2), the shape factor, the variation coefficient in the shape factor, the number variation coefficient in a number particle size distribution, and the ratio of colored particles having no corners are shown in Table 1.

Colored Particle Preparation Example M3

Colored particles (M3) were prepared, similarly to the colored particle preparation example K3, except that in the colored particle preparation example K3, colorant dispersion (1) was replaced by colorant dispersion (3), and particle growth was terminated at the time when the number average particle diameter was grown 5.3 μm. As to these colored particles (M3), the shape factor, the variation coefficient in the shape factor, the number variation coefficient in a number particle size distribution, and the ratio of colored particles having no corners are shown in Table 1.

Colored Particle Preparation Example M4

Colored particles (M4) were prepared, similarly to the colored particle preparation example K4, except that in the colored particle preparation example K4, colorant dispersion (1) was replaced by colorant dispersion (3), and particle growth was terminated at the time when the number average particle diameter was grown 5.5 μm. As to these colored particles (M4), the shape factor, the variation coefficient in the shape factor, the number variation coefficient in a number particle size distribution, and the ratio of colored particles having no corners are shown in Table 1.

Colored Particle Preparation Example M5

Colored particles (M5) were prepared, similarly to the colored particle preparation example M1, except that an anchor type homogenizer was employed as a homogenizer in the colored particle preparation example M1. As to these colored particles (M5), the shape factor, the variation coefficient in the shape factor, the number variation coefficient in a number particle size distribution, and the ratio of colored particles having no corners are shown in Table 1.

Colored Particle Preparation Example C1

Colored particles (C1) were prepared, similarly to the colored particle preparation example K1, except that in the colored particle preparation example K1, colorant dispersion (1) was replaced by colorant dispersion (4), and particle growth was terminated at the time when the number average particle diameter was grown 5.5 μm. As to these colored particles (C1), the shape factor, the variation coefficient in the shape factor, the number variation coefficient in a number particle size distribution, and the ratio of colored particles having no corners are shown in Table 1.

Colored Particle Preparation Example C2

Colored particles (C2) were prepared, similarly to the colored particle preparation example K2, except that in the colored particle preparation example K2, colorant dispersion (1) was replaced by colorant dispersion (4), and particle growth was terminated at the time when the number average particle diameter was grown 5.4 μm by adjusting pH of a dispersion admixture solution to 9.0. As to these colored particles (C2), the shape factor, the variation coefficient in the shape factor, the number variation coefficient in a number particle size distribution, and the ratio of colored particles having no corners are shown in Table 1.

Colored Particle Preparation Example C3

Colored particles (C3) were prepared, similarly to the colored particle preparation example K3, except that in the colored particle preparation example K3, colorant dispersion (1) was replaced by colorant dispersion (4), and particle growth was terminated at the time when the number average particle diameter was grown 5.3 μm. As to these colored particles (C3), the shape factor, the variation coefficient in the shape factor, the number variation coefficient in a number particle size distribution, and the ratio of colored particles having no corners are shown in Table 1.

Colored Particle Preparation Example C4

Colored particles (C4) were prepared, similarly to the colored particle preparation example K4, except that in the colored particle preparation example K4, colorant dispersion (1) was replaced by colorant dispersion (4), and particle growth was terminated at the time when the number average particle diameter was grown 5.5 μm. As to these colored particles (C4), the shape factor, the variation coefficient in the shape factor, the number variation coefficient in a number particle size distribution, and the ratio of colored particles having no corners are shown in Table 1.

Colored Particle Preparation Example C5

Colored particles (C5) were prepared, similarly to the colored particle preparation example C1, except that an anchor type homogenizer was employed as a homogenizer in the colored particle preparation example C1. As to these colored particles (C5), the shape factor, the variation coefficient in the shape factor, the number variation coefficient in a number particle size distribution, and the ratio of colored particles having no corners are shown in Table 1.

Toner Preparation Example

Silica of 1.0 part by weight in which the number average primary particle diameter is 12 nm, and a degree of hydrophobicity is 80 and titania of 1.0 part by weight in which the number average primary particle diameter is 25 nm, and a degree of hydrophobicity is 80 are added into each 100 parts by weight of a total of 20 kinds of colored particles (K1)-(C5), and the mixing process was conducted employing a HENSCHEL MIXER to prepare toner (K1)-toner (C5). Incidentally, as to toner particles constituting the above toner, neither shape nor particle diameter varied even though external additives were added.

Comparative Toner Preparation Example 1

Terephthalic acid of 299 g, polyoxypropylene (2,2)-2,2-bis (4-hydroxyphenyl) propane of 211 g, and pentaerythritol of 82 g were introduced into a round-bottomed flask equipped with a thermometer, a stainless steel stirrer, a glass nitrogen gas introducing tube and a reflux condenser, and this flask into which nitrogen gas was introduced via the nitrogen gas introducing tube was placed on a mantle heater. After the interior of this flask was filled with inert gas, temperature was increased. Subsequently, dibutyltin oxide of 0.05 g was added, and the reaction was conducted at 200° C. after pursuing the reaction at the softening point to prepare polyester resin A of chloroform insoluble matter of 12 W by weight. The glass transition point and the softening point of this polyester resin A were 59° C. and 131° C., respectively. Polyester resin A of 100 parts by weight, carbon black of 6 parts by weight, and pentaerythritol tetrabehenic acid ester of 6 parts by weight were mixed, fused, kneaded, cooled off, pulverized, and classified to prepare comparative colored particles (K6) having 6.8 μm in median diameter in terms of a volume standard, and hydrophobic silica (12 nm in number average primary particle diameter) of 1.0 part by weight and hydrophobic titanium oxide (25 nm in number average primary particle diameter) of 1.2 parts by weight were subsequently added, and the mixing process was conducted employing a HENSCHEL MIXER to prepare a comparative toner (K6). As to these comparative colored particles (K6), the shape factor, the variation coefficient in the shape factor, the number variation coefficient in a number particle size distribution, and the ratio of colored particles having no corners are shown in Table 1.

Comparative Toner Preparation Example 2

Comparative colored particles (Y6) having 6.8 μm in median diameter in terms of a volume standard were prepared, similarly to comparative colored particles (K6), and also comparative toner (Y6) was prepared, similarly to comparative toner preparation example 1, except that in the comparative toner preparation example 1, carbon black was replaced by pigment "C.I. Pigment Yellow 185" of 8 parts by weight. As to these comparative colored particles (Y6), the shape factor, the variation coefficient in the shape factor, the number variation coefficient in a number particle size distribution, and the ratio of colored particles having no corners are shown in Table 1.

Comparative Toner Preparation Example 3

Comparative colored particles (M6) having 6.8 μm in median diameter in terms of a volume standard were prepared, similarly to comparative colored particles (K6), and also comparative toner (M6) was prepared, similarly to comparative toner preparation example 1, except that in the comparative toner preparation example 1, carbon black was replaced by quinacridone type magenta pigment "C.I. Pigment Red 122" of 9 parts by weight. As to these comparative colored particles (M6), the shape factor, the variation coefficient in the shape factor, the number variation coefficient in a number particle size distribution, and the ratio of colored particles having no corners are shown in Table 1.

Comparative Toner Preparation Example 4

Comparative colored particles (C6) having 6.8 μm in median diameter in terms of a volume standard were prepared, similarly to comparative colored particles (K6), and also comparative toner (C6) was prepared, similarly to comparative toner preparation example 1, except that in the comparative toner preparation example 1, carbon black was replaced by phthalocyanine type cyan pigment "C.I. Pigment Blue 15:3" of 9 parts by weight. As to these comparative colored particles (C6), the shape factor, the variation coefficient in the shape factor, the number variation coefficient in a number particle size distribution, and the ratio of colored particles having no corners are shown in Table 1.

TABLE 1

| Toner | Ratio of toner particles in the range of 1.0-1.6 in shape factor (% by number) | Variation coefficient in shape factor (%) | Ratio of toner particles having no corners (% by number) | Number variation coefficient in number particle size distribution (%) |
|---|---|---|---|---|
| Toner (K1) | 91.2 | 12.4 | 94 | 21.5 |
| Toner (K2) | 90.3 | 12.2 | 90 | 20.5 |
| Toner (K3) | 87.1 | 13.5 | 92 | 22.1 |
| Toner (K4) | 86.8 | 14.1 | 90 | 23.1 |
| Toner (K5) | 85.2 | 16.1 | 78 | 25.8 |
| Toner (Y1) | 91.2 | 12.3 | 93 | 21.4 |
| Toner (Y2) | 90.1 | 12.3 | 91 | 20.8 |
| Toner (Y3) | 87.1 | 13.9 | 91 | 22.4 |
| Toner (Y4) | 86.1 | 12.9 | 90 | 22.9 |
| Toner (Y5) | 84.0 | 16.6 | 75 | 26.3 |
| Toner (M1) | 91.3 | 12.2 | 95 | 21.3 |
| Toner (M2) | 90.2 | 12.1 | 92 | 20.5 |
| Toner (M3) | 87.7 | 13.4 | 91 | 22.5 |
| Toner (M4) | 87.1 | 13.9 | 92 | 21.9 |
| Toner (M5) | 83.9 | 16.8 | 71 | 26.9 |
| Toner (C1) | 91.1 | 12.1 | 93 | 21.9 |
| Toner (C2) | 90.8 | 12.1 | 91 | 20.5 |
| Toner (C3) | 87.1 | 13.7 | 91 | 22.6 |
| Toner (C4) | 88.1 | 12.9 | 90 | 22.8 |
| Toner (C5) | 83.2 | 16.9 | 71 | 26.6 |
| Comparative toner (K6) | 61.9 | 19.4 | 41 | 28.1 |
| Comparative toner (Y6) | 61.8 | 19.2 | 43 | 28.3 |
| Comparative toner (M6) | 61.9 | 20.1 | 41 | 28.4 |
| Comparative toner (C6) | 62.1 | 19.5 | 42 | 28.1 |

Developer Preparation Example

Each of developers (K1)-(C5) and comparative developers (K6)-(C6) was prepared by mixing 20 g each of 20 kinds of toners (K1)-(C5) produced as shown above and 4 kinds of comparative toners (K6)-(C6) with 400 g of 45 μm ferrite carrier coated by acryl resin.

Examples 1-5, and Comparative Example 1

Employing a copying machine "bizhub C500" produced by Konica Minolta Holdings, Inc., 20 kinds of developers (K1)-(C5) and 4 kinds of comparative developers (K6)-(C6) were used in combination with developers (K1), (Y1), (C1) and (M1) in the case of Example 1, in combination with developers (K2), (Y2), (C2) and (M2) in the case of Example 2, in combination with developers (K3), (Y3), (C3) and (M3) in the case of Example 3, in combination with developers (K4), (Y4), (C4) and (M4) in the case of Example 4, in combination with developers (K5), (Y5), (C5) and (M5) in the case of Example 5, or in combination with comparative developers (K6), (Y6), (C6) and (M6) in the case of Comparative example 6, and full color images were formed under the following conditions, whereby fog density, fine line reproduction and occurrence or no occurrence of an off-setting phenomenon in the fixing process were evaluated. Results are shown in Table 2. [LATENT IMAGE CARRIER]: A multilayer type photoreceptor was employed as a latent image carrier, and the surface voltage of the photoreceptor was set to −750 V. [DEVELOPING DEVICE]: A contact developing type device was employed as a developing device, and an AC voltage of 2700 V in peak-to-peak voltage ($V_{P-P}$) with 2000 Hz in frequency was set to be superimposed on −610 V in DC voltage.

[FIXING DEVICE]: A pressing contact heat-fixing type device was employed as a fixing device. The constitution is as follows:

The fixing device includes an upper roller having a diameter of 30 mm, composed of cylindrical iron, whose surface is coated by a tetrafluoroethylene-perfluoroalkylvinyl ether copolymer, in which a heater is installed in the center portion, and a lower roller having a diameter of 30 mm, composed of silicone rubber, whose surface is similarly coated by a tetrafluoroethylene-perfluoroalkylvinyl ether copolymer. The line pressure and the nip width was set to 0.8 kg/cm and 4.3 mm, respectively. The line speed of printing was set to 250 mm/sec. employing this fixing device. The fixing temperature was controlled by the surface temperature of the upper roller, and set to 185° C. In addition, a system of pressing a pad impregnated with polydiphenyl silicone (having 10,000 cp in viscosity at 20° C.) was used as a cleaning system of the fixing device.

[Evaluation of Fog Density]

The absolute image density of not printed white paper was measured at 20 points employing Macbeth reflective densitometer RD-918, manufactured by Macbeth Co., Ltd., and the average of the measured values was defined as the density of white paper. The 200,000 images were formed at a pixel ratio of 15% in each color of full color in a sheet-by-sheet intermittent mode at high-temperature and humidity of 30° C. and 80% RH, as to the white portion of an image formed on the $200{,}000^{th}$ sheet of print, the absolute image density was similarly measured at 20 points to calculate the average value, and the difference of this average density and the density of white paper was evaluated as the fog density. When the fog density is 0.005 or less, the fog produces no problem in the practical use.

[Evaluation of Fine Line Reproduction]

Resolution of line images forming four color toners with dots (fine line reproduction) was evaluated at the initial stage of image formation as well as after image formation of 200000 sheets, as to the image formation of 200000 sheets conducted in fog density evaluation. A line image is formed in the horizontal direction crossing the developing direction of an image forming apparatus, and the resolution expressed in lines/mm was evaluated using a 10-power hand magnifier.

[Evaluation of Occurrence of Off-Setting Phenomenon in the Fixing Process and Pad Contamination]

Employing a full color halftone image formed at a pixel ratio of 15% in each color, 10,000 sheets were continuously printed at low-temperature and humidity of 10° C. and 10% RH. Next, after stopping the machine over night, the machine started up again, presence and non-presence of a contaminated image generated on the first sheet via an off-setting phenomenon in the fixing process, and the pad contamination were visually evaluated. The toner fixation becomes difficult since temperature of transfer paper sheets employed for evaluation is low because of the evaluation made at low temperature. In cases when insufficient toner fixation results, a part of toner is moved to the upper fixing roller, whereby an off-setting phenomenon is generated. In the case of pressing a pad against the upper fixing roller in a cleaning mechanism of fixation, unfixed toner is accumulated in the pad. In the case of printing continuously, in particular, the fixation becomes difficult since the surface temperature of the upper fixing roller is gradually lowered. In the case of printing the first paper sheet after the apparatus is sufficiently out of operation, the toner accumulated in the pad is ejected, whereby the off-setting phenomenon is generated, since the surface temperature of the upper fixing roller has risen sufficiently.

TABLE 2

| | Developers in combination | Fog density | Fine line Reproduction (lines/mm) *1 | *2 | Off-setting phenomenon (fixing process) | Pad contamination |
|---|---|---|---|---|---|---|
| Example 1 | K1/Y1/M1/C1 | 0.001 | 8 | 8 | No occurrence | Not contaminated |
| Example 2 | K2/Y2/M2/C2 | 0.001 | 8 | 8 | No occurrence | Not contamination |
| Example 3 | K3/Y3/M3/C3 | 0.001 | 8 | 7 | No occurrence | Not contaminated |
| Example 4 | K4/Y4/M4/C4 | 0.001 | 8 | 7 | No occurrence | Not contaminated |
| Example 5 | K5/Y5/M5/C5 | 0.003 | 7 | 6 | No occurrence | Roughly not contaminated |
| Comparative example 1 | K6/Y6/M6/C6 | 0.009 | 6 | 4 | occurrence | Heavily contaminated |

*1: at the initial stage of image formation
*2: after image formation of 200000 sheets As is clear from Table 2, when images were formed by using toners in Examples 1-5, the fog density caused by a formed image was 0.005 or less, no occurrence of fog was substantially confirmed. As to contamination caused by the off-setting phenomenon in the fixing process, and the pad contamination, it was also confirmed that no problem was produced in the practical use. On the other hand, when an image was formed by using a toner in Comparative example 1, not only occurrence of fog presumably caused by a wax releasing phenomenon, but also occurrence of the off-setting phenomenon in the fixing process, and the pad contamination were observed.

[Effect of the Invention]

After considerable effort during intensive studies, the inventors have found out that oil-droplets made of carboxylic acid with at least divalence and alcohol with at least divalence as the raw material for a polyester resin, accompanied with wax as a releasing agent are prepared, and the wax-containing polyester resin particles in which wax is evenly dispersed in the polyester resin are prepared by forming the polyester resin via condensation-polymerization of the foregoing carboxylic acid and alcohol under the presence of wax, whereby the polymerized toner is easily prepared with the wax-containing polyester resin particles by coagulating these wax-containing polyester resin particles together with colorant particles in the aqueous medium.

According to the manufacturing method of toner in the present invention, the toner is easily prepared with wax-containing polyester resin particles, since polyester resin particles can be prepared via condensation-polymerization under the presence of wax in the aqueous medium, employing oil-droplets containing wax and the raw material for the polyester resin in the polymerization process. That is to say, wax and the raw material to polymerize a polyester resin without mixing wax the polyester resin itself and wax are mixed or dissolved to form oil-droplets via dispersion in the water medium containing a surfactant having a specific acidic group. Next, wax-containing polyester resin particles in which wax is evenly dispersed can be easily prepared via condensation-polymerization of carboxylic acid with at least divalence and alcohol with at least divalence as the raw material for polyester resin particles under the presence of wax, whereby colored particles can be obtained by coagulating the wax-containing polyester resin particles together with colorant particles and others to easily prepare toner in which wax is evenly dispersed.

According to the manufacturing method of toner in the present invention, wax-containing polyester resin particles having a cross-linking structure can be acquired via the polymerization process by employing the polymerizable monomer to prepare wax-containing polyester resin particles, containing at least one kind of carboxylic acid with trivalence or more, or at least one kind of alcohol with trivalence or more. Accordingly, the toner possessing wax-containing polyester resin particles having a cross-linking structure can be easily prepared.

Further, in the manufacturing method of toner in the present invention, the toner can be prepared more easily by conducting a process to coagulate wax-containing polyester resin particles in the aqueous medium in which oil droplets are formed during the polymerization process, since both the polymerization process and the coagulation process can be continuously conducted without changing the reaction vessel.

According to a toner of the present invention, since toner particles constituting the toner possess basically wax-containing polyester resin particles in which wax is evenly dispersed in a polyester resin, occurrence of an off-setting phenomenon in a fixing process is eliminated due to excellent viscoelasticity of the polyester resin, and a releasing property of wax contained in the toner, whereby excellent fixability at low temperature is achieved. Since these wax-containing polyester resin particles are also prepared via a specific polymerization process with no occurrence of a wax releasing phenomenon, and no size fluctuation in small particle diameter results, not only excellent fixability to a transfer material is realized by producing toner particles having a sharp charge amount distribution, but also excellent fine line reproduction is realized in formed images, so that high quality images can be stably formed over a long duration.

Based on the image forming method of the present invention, high quality images can be stably formed over a long duration, employing the above-mentioned toner.

What is claimed is:

1. A toner prepared by a method of manufacturing the toner comprising the steps of:

conducting a polymerization process for acquiring wax-containing polyester resin particles via condensation-polymerization of carboxylic acid and alcohol employing oil droplets after forming the oil droplets made of wax and a polymerizable monomer containing at least one kind of carboxylic acid with divalence or more and at least one kind of alcohol with divalence or more in an aqueos medium containing a surfactant including a compound having a long chain hydrocarbon group and acidic group; and conducting a process of coagulating at least the wax-containing polyester particles in the aqueous medium.

2. The toner of claim 1, wherein a ratio of toner particles having a shape factor in the range of 1.0-1.6 is at least 65% by number based on the number of all toner particles.

3. The toner of claim 1, wherein the toner particles have a shape factor variation coefficient of not more than 16%.

4. The toner of claim 1, wherein the toner particles have a number variation coefficient in a number particle size distribution of not more than 27%.

5. The toner of claim 1, wherein a ratio of colored particles having no corners is at least 50% by number based on the number of all toner particles.

6. An image forming method comprising the steps of:

developing a latent image to be visualized, formed on a latent image carrier with a toner; and transferring the toner onto a transfer material, wherein the toner of claim 1 is employed.

7. The toner of claim 1, wherein the oil droplets after dispersing have a number average particle diameter of 50-500 nm.

8. The toner of claim 1, wherein the oil droplets after dispersing have a number average particle diameter of 70-300 nm.

* * * * *